US010615545B2

(12) United States Patent
Jin et al.

(10) Patent No.: US 10,615,545 B2
(45) Date of Patent: Apr. 7, 2020

(54) ELECTRICAL CONNECTOR HAVING SHIELDING SHEET TO REDUCE CROSSTALK

(71) Applicant: LOTES CO., LTD, Keelung (TW)

(72) Inventors: Zuo Feng Jin, Keelung (TW); Shan Ju Yang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/299,528

(22) Filed: Mar. 12, 2019

(65) Prior Publication Data

US 2019/0296498 A1 Sep. 26, 2019

(30) Foreign Application Priority Data

Mar. 21, 2018 (CN) ..... 2018 1 0232577

(51) Int. Cl.

| | |
|---|---|
| ***H01R 13/6585*** | (2011.01) |
| ***H01R 12/72*** | (2011.01) |
| ***H01R 13/193*** | (2006.01) |
| ***H01R 13/502*** | (2006.01) |
| ***H01R 13/6583*** | (2011.01) |
| ***H01R 13/6594*** | (2011.01) |

(Continued)

(52) U.S. Cl.

CPC ..... *H01R 13/6585* (2013.01); *H01R 12/724* (2013.01); *H01R 13/193* (2013.01); *H01R 13/502* (2013.01); *H01R 13/6583* (2013.01); *H01R 13/6594* (2013.01); *H01R 24/60* (2013.01); *H01R 2107/00* (2013.01)

(58) Field of Classification Search

CPC ..... H01R 13/113; H01R 13/193; H01R 13/6585; H01R 13/6583; H01R 12/724

USPC ..... 439/86, 90, 816, 817, 839, 593, 259, 439/607.5, 607.11

See application file for complete search history.

(56) References Cited

U.S. PATENT DOCUMENTS 4,392,705 A * 7/1983 Andrews, Jr. ..... H01R 12/89 439/259
4,407,555 A * 10/1983 Lockard ..... H05K 7/1007 439/259

(Continued)

FOREIGN PATENT DOCUMENTS

CN 204947150 U 1/2016

*Primary Examiner* — Tulsidas C Patel
*Assistant Examiner* — Marcus E Harcum
(74) *Attorney, Agent, or Firm* — Locke Lord LLP; Tim Tingkang Xia, Esq.

(57) ABSTRACT

An electrical connector is used to mate with a mating connector. The mating connector includes multiple mating terminals, and each mating terminal has a first contact portion. The electrical connector includes: an insulating body having a mating space used to mate with the mating connector; a shielding sheet accommodated in the insulating body; multiple contact terminals, each being accommodated in the insulating body and located at one side of the shielding sheet, and each has a second contact portion exposed to the mating space; and an elastic body accommodated in the insulating body and partially exposed to the mating space. The elastic body is located between the shielding sheet and the contact terminals. When the electric connector is mated with the mating connector, the first contact portions enters into the mating space, and the elastic body forces each first contact portion abuts a corresponding second contact portion.

20 Claims, 7 Drawing Sheets

(51) Int. Cl.
*H01R 24/60* (2011.01)
*H01R 107/00* (2006.01)

(56) References Cited

U.S. PATENT DOCUMENTS

| | | | | | |
|---|---|---|---|---|---|
| 4,824,383 | A * | 4/1989 | Lemke | H01R 24/60 | 439/108 |
| 5,813,871 | A * | 9/1998 | Grabbe | H01R 23/688 | 439/108 |
| 5,938,450 | A * | 8/1999 | Nagafuji | H01R 13/6585 | 439/607.07 |
| 7,572,137 | B2 * | 8/2009 | Fekonja | H01R 13/193 | 439/259 |
| 8,272,905 | B2 * | 9/2012 | Yang | H01R 13/113 | 439/816 |
| 9,246,279 | B2 * | 1/2016 | Kato | H01R 13/6596 | |
| 9,806,476 | B2 * | 10/2017 | Long | H01R 13/641 | |
| 10,027,063 | B2 * | 7/2018 | Peng | H01R 12/594 | |
| 2006/0089018 | A1 * | 4/2006 | Orita | H01R 12/57 | 439/74 |
| 2010/0159746 | A1 * | 6/2010 | Wan | H01R 13/65802 | 439/607.11 |
| 2012/0244755 | A1 * | 9/2012 | Suzuki | H01R 13/193 | 439/660 |
| 2018/0076546 | A1 * | 3/2018 | Tamai | H01R 13/6315 | |
| 2018/0183189 | A1 * | 6/2018 | Chuang | H01R 13/6585 | |
| 2019/0214760 | A1 * | 7/2019 | Beck | H01R 13/113 | |

* cited by examiner

100

200

ELECTRICAL CONNECTOR HAVING SHIELDING SHEET TO REDUCE CROSSTALK

CROSS-REFERENCE TO RELATED PATENT APPLICATION

This non-provisional application claims priority to and the benefit of, pursuant to 35 U.S.C. § 119(a), patent application Serial No. CN201810232577.3 filed in China on Mar. 21, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector with good high-frequency performances.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Currently, an existing electrical connector includes an insulating body and a plurality of flat terminals fixedly arranged on the insulating body. For convenient usage, the existing electrical connector adopts the arrangement of terminals in an upper row and a lower row in order to implement forward and reverse insertion of a mating connector. During mating, the flat plate terminals of the electrical connector are mated with the mating terminals of a mating connector. Each mating terminal is an elastic terminal, and the tail end of each mating terminal bends upward to form a guiding portion in order to prevent buckling to the mating terminals during mating. However, the guiding portion of each mating terminal is not in contact with the corresponding flat plate terminal, which leads to the open stab effect, thereby affecting the transmission quality of signals. In particular, in high-frequency signal transmission, the negative effects of the open stab become significant, such that a serious signal distortion may occur. Meanwhile, the design of the upper and lower rows of terminals would cause crosstalk during high-frequency signal transmission, thereby affecting the signal transmission.

Therefore, a heretofore unaddressed need to design an improved electrical connector exists in the art to address the aforementioned deficiencies and inadequacies.

SUMMARY

In view of the deficiencies in the background, the present invention is directed to an electrical connector, in which a shielding sheet is provided to alleviate crosstalk in order to implement the stability of high-frequency signal transmission.

To achieve the foregoing objective, the invention adopts the following technical solutions.

An electrical connector is configured to mate with a mating connector. The mating connector includes a plurality of mating terminals, and each of the mating terminals has a first contact portion. The electrical connector includes: an insulating body, having a mating space, configured to mate with the mating connector; a shielding sheet, accommodated in the insulating body; a plurality of contact terminals, each being accommodated in the insulating body and located at one side of the shielding sheet, wherein each of the contact terminals has a second contact portion exposed to the mating space; and an elastic body, accommodated in the insulating body and partially exposed to the mating space, wherein the elastic body is located between the shielding sheet and the contact terminals. When the electric connector is mated with the mating connector, the first contact portion of each of the mating terminals enters into the mating space and applies an acting force to the elastic body, and the elastic body applies a counter acting force to the first contact portion of each of the mating terminals, such that the first contact portion of each of the mating terminals abuts the second contact portion of a corresponding one of the contact terminals.

In certain embodiments, a free end of the first contact portion is in contact with the second contact portion, and a free end of the second contact portion is in contact with the first contact portion.

In certain embodiments, the first contact portion and the second contact portion are both horizontal plate shaped, and the first contact portion and the second contact portion are in surface contact.

In certain embodiments, the insulating body has a positioning portion, and the positioning portion stops the second contact portion of each of the contact terminals.

In certain embodiments, the contact terminals comprise at least one grounding terminal, the mating space has a mating opening, and a front end of the grounding terminal is closer to the mating opening than a front end of the elastic body.

In certain embodiments, the first contact portion is located between the elastic body and the second contact portion.

In certain embodiments, the insulating body has a base, one side of the base extends to form an upper plate body and a lower plate body, the second contact portions of the contact terminals are exposed to a lower surface of the upper plate body and an upper surface of the lower plate body, and the elastic body and the shielding sheet are located between the upper plate body and the lower plate body.

In certain embodiments, an accommodating cavity is provided between the elastic body and the contact terminals, the accommodating cavity is configured to be inserted by the mating terminals, and a height of the accommodating cavity is less than a thickness of each of the mating terminals.

In certain embodiments, a front end of the elastic body is provided with a guiding portion, and the mating terminals enter into the accommodating cavity along the guiding portion.

In certain embodiments, the elastic body wraps the shielding sheet, and a front end surface of the shielding sheet and two side surfaces of the shielding sheet are exposed to the elastic body respectively.

Meanwhile, another technical solution is provided. An electrical connector is configured to mate with a mating connector. The mating connector includes a plurality of mating terminals, and each of the mating terminals has a first contact portion. The electrical connector includes: an insulating body, having a base and a tongue located at one side of the base, wherein the insulating body has a mating space configured to mate with the mating connector, and the tongue is exposed to the mating space; a shielding sheet, accommodated in the tongue; and a plurality of contact terminals, each being accommodated in the base and located at one side of the tongue, wherein an accommodating cavity is provided between the tongue and the contact terminals, and each of the contact terminals has a second contact portion exposed to the accommodating cavity. When the electrical connector is mated with the mating connector, the mating terminals enter into the accommodating cavity, and the first contact portion of each of the mating terminals abuts the second contact portion of a corresponding one of the contact terminals.

In certain embodiments, a free end of the first contact portion is in contact with the second contact portion, and a free end of the second contact portion is in contact with the first contact portion.

In certain embodiments, the first contact portion and the second contact portion are both horizontal plate shaped, and the first contact portion and the second contact portion are in surface contact.

In certain embodiments, the insulating body has a positioning portion, and the positioning portion stops the second contact portion of each of the contact terminals.

In certain embodiments, the positioning portion stops a free end of the second contact portion of each of the contact terminals.

In certain embodiments, the one side of the base extends to form an upper plate body and a lower plate body, the second contact portions of the contact terminals are exposed to a lower surface of the upper plate body and an upper surface of the lower plate body, and the tongue is located between the upper plate body and the lower plate body.

In certain embodiments, a front end of the tongue is provided with a guiding portion, and the mating terminals enter into the accommodating cavity along the guiding portion.

In certain embodiments, the tongue is made of an elastic plastic material.

In certain embodiments, each of the mating terminals applies a force to the tongue and the tongue applies a counter force to each of the mating terminals, such that the first contact portion of each of the mating terminals abuts the second contact portion of the corresponding one of the contact terminals.

In certain embodiments, a height of the accommodating cavity is less than a thickness of each of the mating terminals.

Compared with the related art, certain embodiments of the present invention have the following beneficial effects.

Through providing the shielding sheet between two rows of the contact terminals, the crosstalk is reduced effectively, and the stability of high-frequency signal transmission is implemented. Meanwhile, through providing the elastic body, each first contact portion applies a force to the elastic body and the elastic body applies a counter force to each first contact portion, such that each first contact portion abuts a corresponding second contact portion. The elastic body allows the first contact portion and the second contact portion maintain a better contact force, improving the stability of high-frequency signal transmission.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
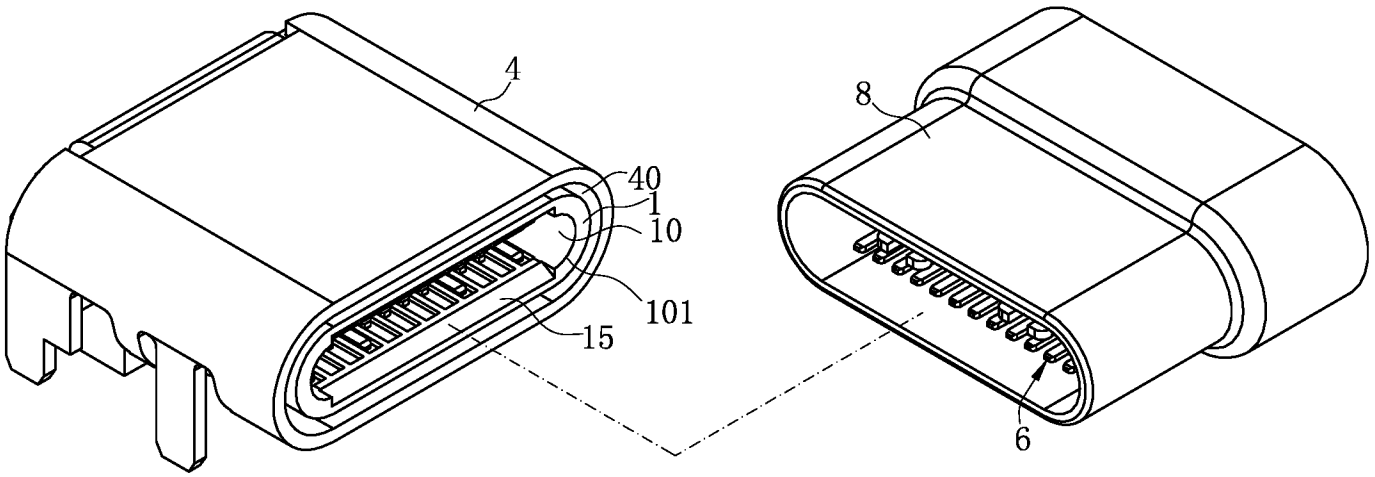
FIG. 1 is a perspective assembled view of an electrical connector and a mating connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to an electrical connector.

FIG. 1 shows an electrical connector 100 according to certain embodiments of the present invention, which is used to mate with a mating connector 200, and includes: an insulating body 1, and multiple contact terminals 2 accommodated in the insulating body 1.

Figure 2:
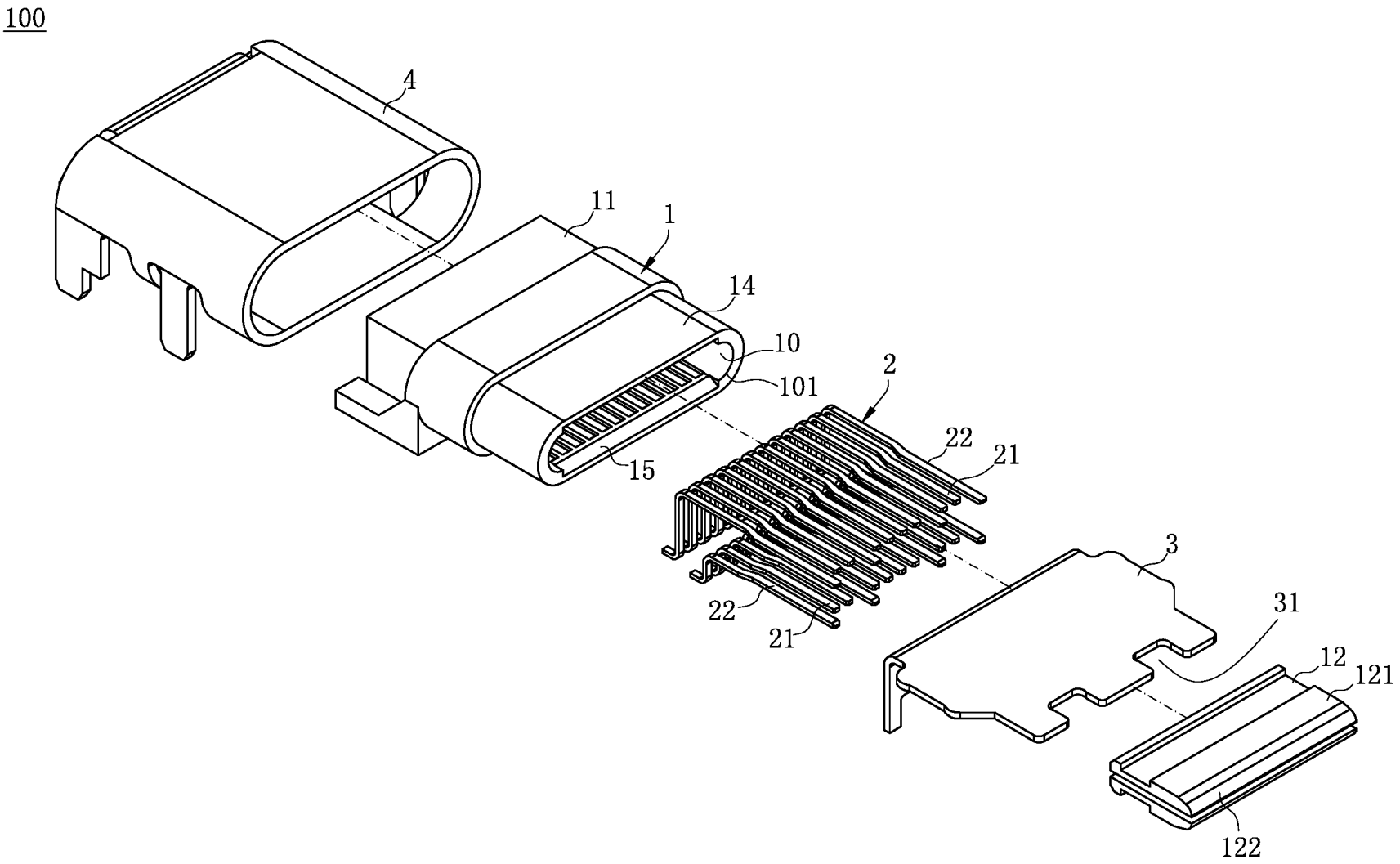
FIG. 2 is a perspective exploded view of an electrical connector according to certain embodiments of the present invention.

As shown in FIG. 2 and FIG. 0.5, the insulating body 1 has a mating space 10, which is used to mate with the mating connector 200. The mating space 10 has a mating opening 101 for the mating connector 200 to enter therein. The insulating body 1 has a base 11 and a tongue 12 located at one side of the base 11, and the one side of the base 11 extends to form an upper plate body 14 and a lower plate body 15. Each of the upper plate body 14 and the lower plate body 15 has a positioning portion 16. The positioning portion 16 stopping the contact terminals 2. The tongue 12 is located between the upper plate body 14 and lower plate body 15, and a front end of tongue 12 is provided with a guiding portion 122. The upper plate body 14, the lower plate body 15 and the tongue 12 are exposed to the mating space 10.

Figure 3:
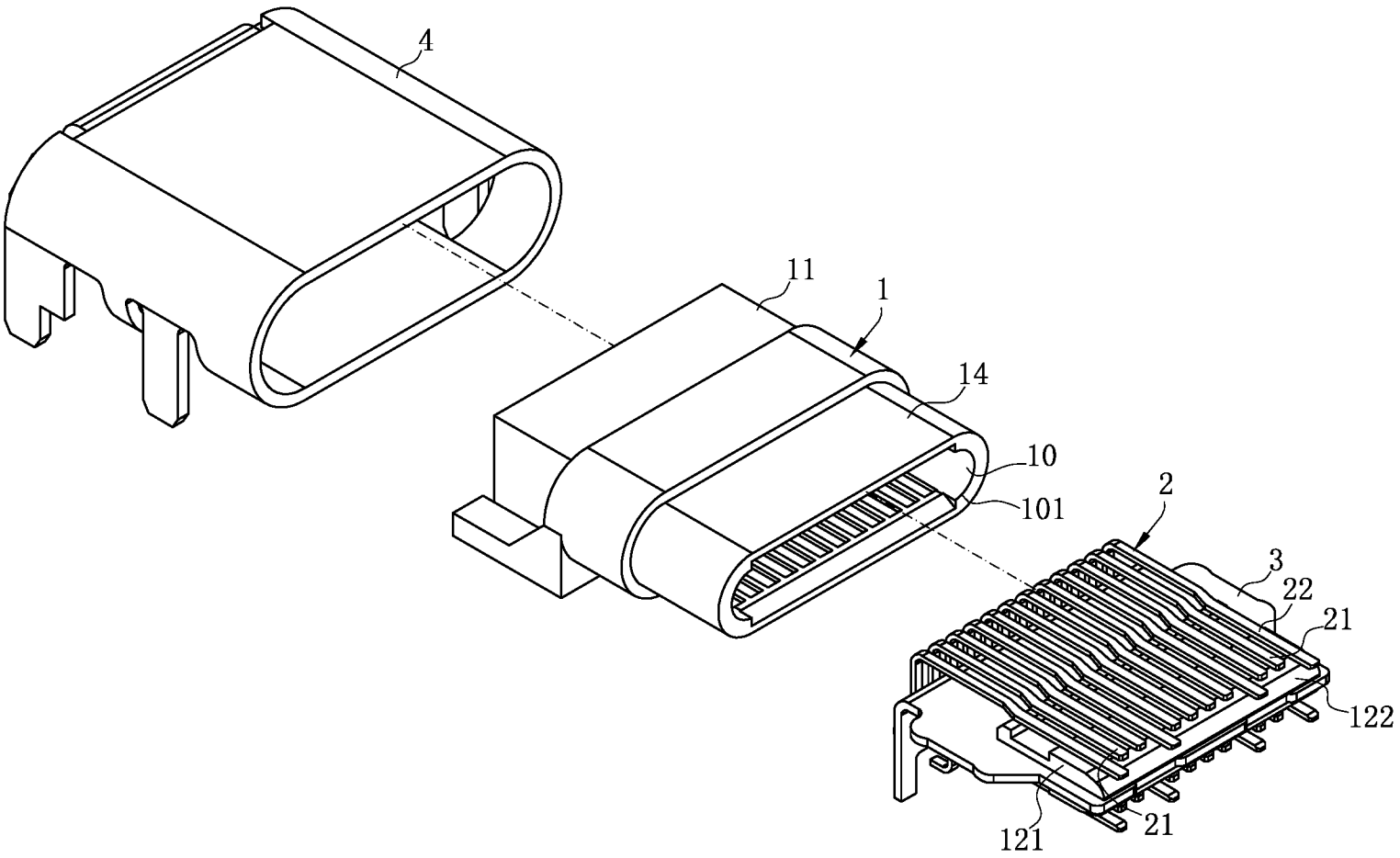
FIG. 3 is a perspective local assembled view of an electrical connector according to certain embodiments of the present invention.
Figure 5:
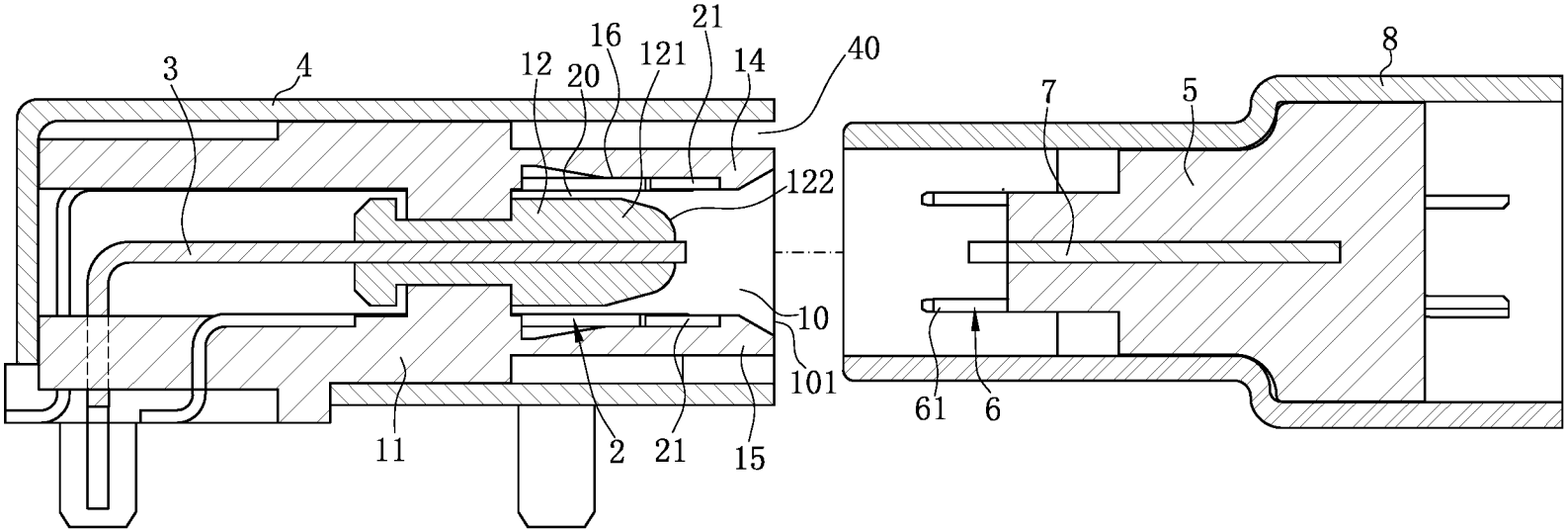
FIG. 5 is a sectional view of an electrical connector and a mating connector according to certain embodiments of the present invention.

As shown in FIG. 3 and FIG. 5, multiple terminals 2 are fixedly provided on the base 11 respectively. Each contact terminal 2 has a second contact portion 21. The second contact portions 21 of the contact terminals 2 are exposed to the lower surface of the upper plate body 14 and the upper surface of the lower plate body 15. An accommodating cavity 20 is provided between the tongue 12 and the second contact portions 21, and the second contact portions 21 of the contact terminals 2 are exposed to the accommodating cavity 20. The contact terminals 2 include two ground terminals 22, and a front end of each ground terminal 22 is more closer to the mating opening 101 than the front end of the tongue 12.

As shown in FIG. 2, FIG. 3 and FIG. 5, a shielding sheet 3 is provided. The shielding sheet 3 is accommodated received in the tongue 12 and located between the upper plate body 14 and the lower plate body 15. A front end surface and two side surfaces of the shielding sheet 3 are respectively exposed to the tongue 12, and two grooves 31 are concavely provided backward from the front end surface of the shielding sheet 3.

As shown in FIG. 1 and FIG. 5, a shielding shell 4 is provided. The shielding shell 4 is sleeved over the insulating body 1, and an accommodating cavity 40 is provided between the shielding shell 4 and the insulating body 1.

Figure 4:
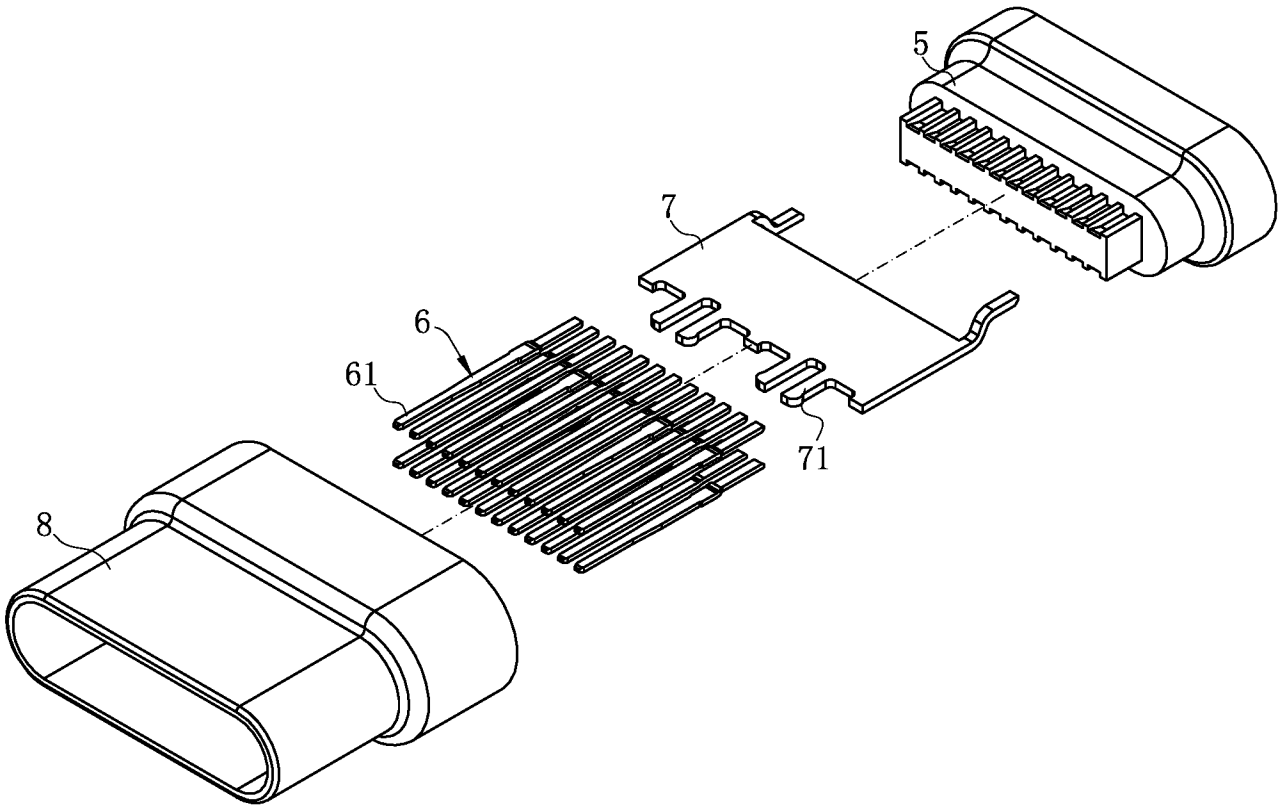
FIG. 4 is a perspective exploded view of a mating connector according to certain embodiments of the present invention.
Figure 6:
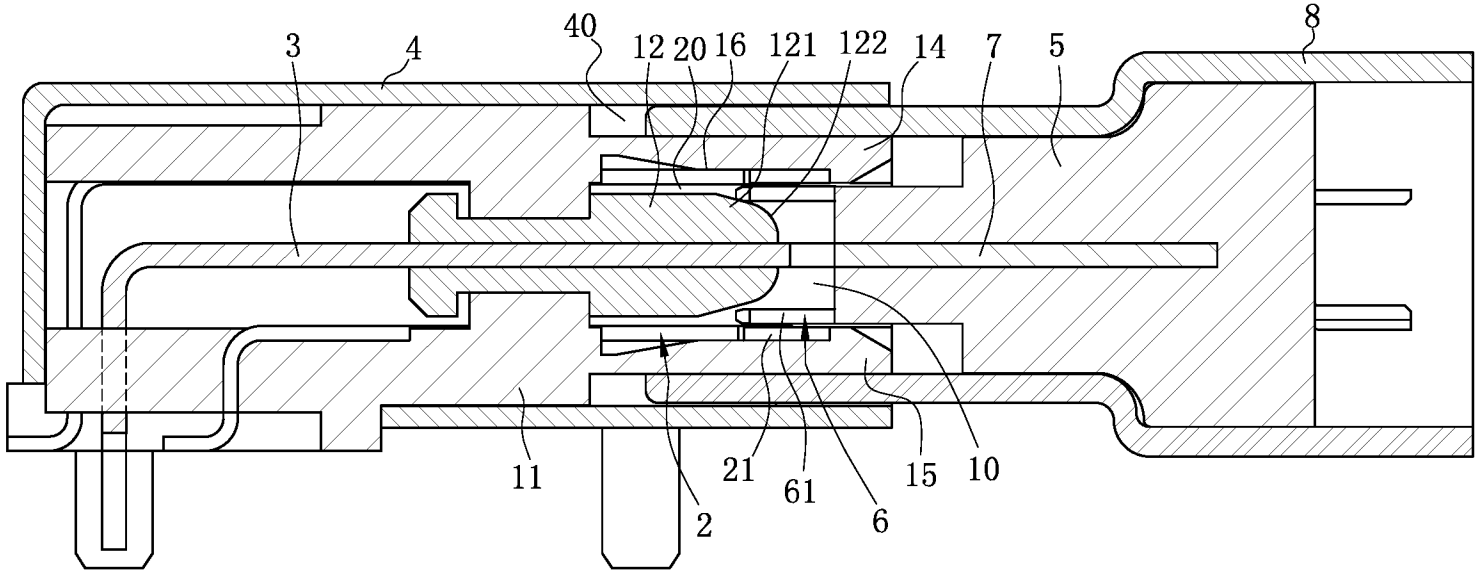
FIG. 6 is a sectional view of an electrical connector and a mating connector in a mating process according to certain embodiments of the present invention.

As shown in FIG. 4 and FIG. 6, the mating connector 200 includes a mating body 5. Multiple mating terminals 6 are fixedly provided in an upper row and a lower row on the mating body 5. A middle iron sheet 7 is fixedly provided on the mating body 5, and is located between the two rows of mating terminals 6. A front end surface of the middle iron sheet 7 extends forward to form two fastening portions 71, and the two fastening portions 71 are exposed to the mating body 5. Each mating terminal 6 has a first contact portion 61. The first contact portion 61 extends forward out of the mating body 5. A metal shell 8 is sleeved over the mating body 5. When the mating connector 200 is mated with the electrical connector 100, the two fastening portions 71 are respectively fastened on the two grooves 31, and the metal shell 8 enters into the accommodating space 40.

Figure 7:
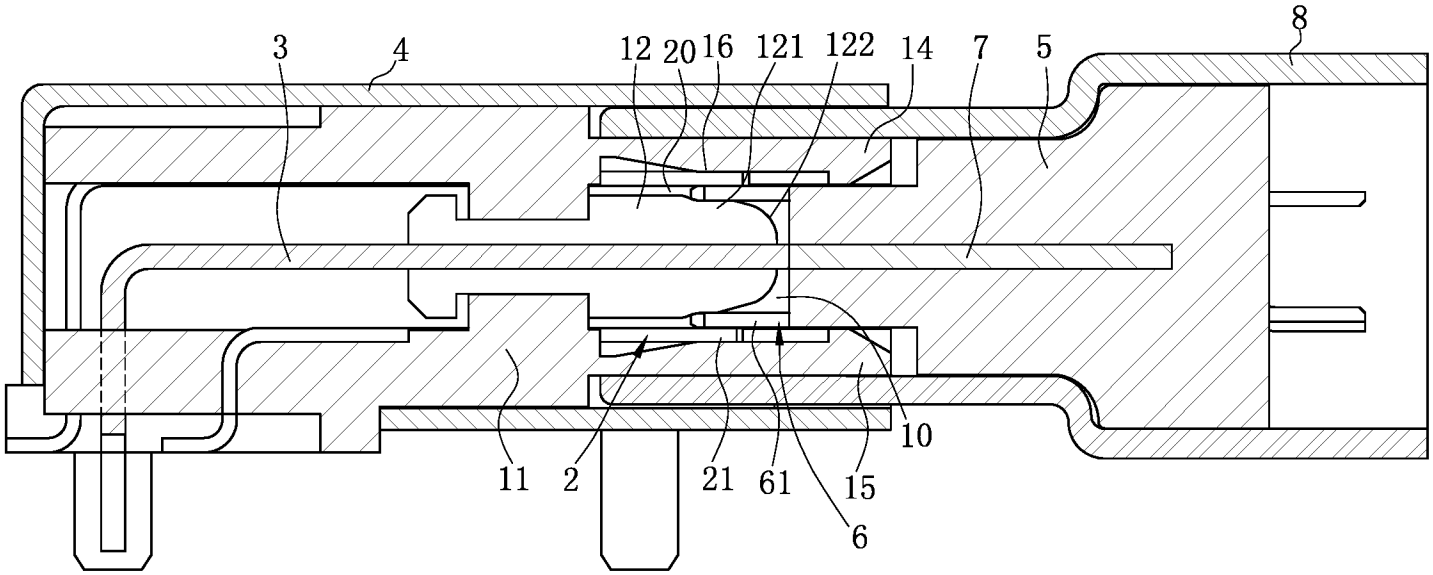
FIG. 7 is another sectional view of an electrical connector and a mating connector in a mating process according to certain embodiments of the present invention.

As shown in FIG. 5, FIG. 6 and FIG. 7, each mating terminal 6 enters into the mating space 10 along the guiding portion 122. Each first contact portion 61 enters into the accommodating cavity 20, and each first contact portion 61 abuts a corresponding second contact portion 21. The positioning portion 16 stops the second contact portions 21 from excessively moving upward. In this embodiment, both the contact terminals 2 and the mating terminals 6 are flat plate terminals. The first contact portions 61 and the second contact portions 21 are both horizontal plates, and each first contact portion 61 and the corresponding second contact portion 21 are in surface contact. Meanwhile, the shielding sheet 3 and the middle iron sheet 7 are in contact with each other. In another embodiment, a free end of the first contact portion 61 abuts the second contact portion 21, and a free end of the second contact portion 21 abuts the first contact portion 61.

FIG. 7 shows a second embodiment of the present invention, which is different from the first embodiment in that: the tongue 12 is an elastic body 121 made of an elastic plastic material (such as rubber). The elastic body 121 wraps the shielding sheet 3. A front end surface of the shielding sheet 3 and the two side surfaces of the shielding sheet are exposed to the elastic body 121. The accommodating cavity 20 is provided between the elastic body 121 and the second contact portions 21, and a height of the accommodating cavity 20 is less than a thickness of each mating terminal 6. Each mating terminal 6 enters into the mating space 10 along the guiding portion 122. Each first contact portion 61 enters into the accommodating cavity 20. Each first contact portion 61 applies a force to the elastic body 121, and the elastic body applies a counter force to each first contact portion 61, such that the first contact portion 61 abuts the corresponding second contact portion 21. Details will not be elaborated herein.

To sum up, the electrical connector 100 according to certain embodiments of the present invention has the following beneficial effects:

(1) Through providing the shielding sheet 3 between two rows of the contact terminals 2, the crosstalk is reduced effectively, and the stability of high-frequency signal transmission is implemented. Meanwhile, through providing the elastic body 121, each first contact portion 61 applies a force to the elastic body 121 and the elastic body 121 applies a counter force to each first contact portion 61, such that each first contact portion 61 abuts a corresponding second contact portion 21. The elastic body 121 allows the first contact portion 61 and the second contact portion 21 maintain a better contact force, improving the stability of high-frequency signal transmission.

(2) Both the contact terminals 2 and the mating terminals 6 are flat plate terminals. The first contact portions 61 and the second contact portions 21 are both horizontal plates, and each first contact portion 61 and the corresponding second contact portion 21 are in surface contact. For each second contact portion 21, there is no portion not to be in contact with the corresponding first contact portion 61, thus eliminating the open stab effect during the high-frequency signal transmission by the contact terminals 2 and the mating terminals 6 and facilitating signal transmission.

(3) The free end of the first contact portion 61 abuts the second contact portion 21, and the free end of the second contact portion 21 abuts the first contact portion 61, thereby eliminating the open stab effect during the high-frequency signal transmission by the contact terminal 2 and the mating terminal 6 and facilitating high-frequency signal transmission.

(4) The shielding sheet 3 and the middle iron sheet 7 are in contact with each other, and the two fastening portions 71 are fastened in the two grooves 31 respectively. The shielding sheet 3 and the middle iron sheet 7 are grounded respectively. This design increases the grounding routes and grounding area of the electrical connector 100 and the mating connector 200 during mating, such that the grounding effect of the electrical connector is better. Meanwhile, the fastening portions 71 and the grooves 31 increase the insertion and extraction force of the electrical connector 100 and the mating connector 200.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to mate with a mating connector, the mating connector comprising a plurality of mating terminals, and each of the mating terminals having a first contact portion, the electrical connector comprising:

an insulating body, having a mating space, configured to mate with the mating connector;

a shielding sheet, accommodated in the insulating body;

a plurality of contact terminals, each being accommodated in the insulating body and located at one side of the shielding sheet, wherein each of the contact terminals has a second contact portion exposed to the mating space; and an elastic body, accommodated in the insulating body and partially exposed to the mating space, wherein the elastic body is located between the shielding sheet and the contact terminals;

wherein when the electric connector is mated with the mating connector, the first contact portion of each of the mating terminals enters into the mating space and applies an acting force to the elastic body, and the elastic body applies a counter acting force to the first contact portion of each of the mating terminals, such that the first contact portion of each of the mating terminals abuts the second contact portion of a corresponding one of the contact terminals.

2. The electrical connector according to claim 1, wherein a free end of the first contact portion is in contact with the second contact portion, and a free end of the second contact portion is in contact with the first contact portion.

3. The electrical connector according to claim 1, wherein the first contact portion and the second contact portion are both horizontal plate shaped, and the first contact portion and the second contact portion are in surface contact.

4. The electrical connector according to claim 1, wherein the insulating body has a positioning portion, and the positioning portion stops the second contact portion of each of the contact terminals.

5. The electrical connector according to claim 1, wherein the contact terminals comprise at least one grounding terminal, the mating space has a mating opening, and a front end of the grounding terminal is closer to the mating opening than a front end of the elastic body.

6. The electrical connector according to claim 1, wherein the first contact portion is located between the elastic body and the second contact portion.

7. The electrical connector according to claim 1, wherein the insulating body has a base, one side of the base extends to form an upper plate body and a lower plate body, the second contact portions of the contact terminals are exposed to a lower surface of the upper plate body and an upper surface of the lower plate body, and the elastic body and the shielding sheet are located between the upper plate body and the lower plate body.

8. The electrical connector according to claim 1, wherein an accommodating cavity is provided between the elastic body and the contact terminals, the accommodating cavity is configured to be inserted by the mating terminals, and a height of the accommodating cavity is less than a thickness of each of the mating terminals.

9. The electrical connector according to claim 8, wherein a front end of the elastic body is provided with a guiding portion, and the mating terminals enter into the accommodating cavity along the guiding portion.

10. The electrical connector according to claim 1, wherein the elastic body wraps the shielding sheet, and a front end surface of the shielding sheet and two side surfaces of the shielding sheet are exposed to the elastic body respectively.

11. An electrical connector, configured to mate with a mating connector, the mating connector comprising a plurality of mating terminals, and each of the mating terminals having a first contact portion, the electrical connector comprising:

an insulating body, having a base and a tongue located at one side of the base, wherein the insulating body has a mating space configured to mate with the mating connector, the tongue is made of an elastic plastic material, and the tongue is exposed to the mating space;

a shielding sheet, accommodated in the tongue; and a plurality of contact terminals, each being accommodated in the base and located at one side of the tongue, wherein an accommodating cavity is provided between the tongue and the contact terminals, and each of the contact terminals has a second contact portion exposed to the accommodating cavity;

whereinwhen the electrical connector is mated with the mating connector, the mating terminals enter into the accommodating cavity, and the first contact portion of each of the mating terminals abuts the second contact portion of a corresponding one of the contact terminals.

12. The electrical connector according to claim 11, wherein the insulating body has a positioning portion, and the positioning portion stops a free end of the second contact portion of each of the contact terminals.

13. The electrical connector according to claim 11, wherein the one side of the base extends to form an upper plate body and a lower plate body, the second contact portions of the contact terminals are exposed to a lower surface of the upper plate body and an upper surface of the lower plate body, and the tongue is located between the upper plate body and the lower plate body.

14. The electrical connector according to claim 11, wherein each of the mating terminals applies a force to the tongue and the tongue applies a counter force to each of the mating terminals, such that the first contact portion of each of the mating terminals abuts the second contact portion of the corresponding one of the contact terminals.

15. The electrical connector according to claim 14, wherein a height of the accommodating cavity is less than a thickness of each of the mating terminals.

16. An electrical connector, configured to mate with a mating connector, the mating connector comprising a plurality of mating terminals, and each of the mating terminals having a first contact portion, the electrical connector comprising:

an insulating body, having a base and a tongue located at one side of the base, wherein the one side of the base extends to form an upper plate body and a lower plate body, the insulating body has a mating space configured to mate with the mating connector, and the tongue is located between the upper plate body and the lower plate body and is exposed to the mating space;

a shielding sheet, accommodated in the tongue; and a plurality of contact terminals, each being accommodated in the base and located at one side of the tongue, wherein an accommodating cavity is provided between the tongue and the contact terminals, and each of the contact terminals has a second contact portion exposed to the accommodating cavity;

wherein the second contact portions of the contact terminals are exposed to a lower surface of the upper plate body and an upper surface of the lower plate body, and when the electrical connector is mated with the mating connector, the mating terminals enter into the accommodating cavity, and the first contact portion of each of the mating terminals abuts the second contact portion of a corresponding one of the contact terminals.

17. The electrical connector according to claim 16, wherein the insulating body has a positioning portion, and the positioning portion stops a free end of the second contact portion of each of the contact terminals.

18. The electrical connector according to claim 16, wherein the tongue is made of an elastic plastic material.

19. The electrical connector according to claim 18, wherein each of the mating terminals applies a force to the tongue and the tongue applies a counter force to each of the mating terminals, such that the first contact portion of each of the mating terminals abuts the second contact portion of the corresponding one of the contact terminals.

20. The electrical connector according to claim 19, wherein a height of the accommodating cavity is less than a thickness of each of the mating terminals.

* * * * *